US007376380B2

(12) United States Patent
Koike et al.

(10) Patent No.: US 7,376,380 B2
(45) Date of Patent: May 20, 2008

(54) IMAGE FORMING APPARATUS, PROCESS CARTRIDGE, AND TONER

(75) Inventors: Toshio Koike, Kanagawa (JP); Ken Amemiya, Tokyo (JP); Yoshiki Hozumi, Kanagawa (JP); Hiromichi Ninomiya, Kanagawa (JP)

(73) Assignee: Ricoh Company, Limted, Tokyo (JP)

( * ) Notice: Subject to any disclaimer, the term of this patent is extended or adjusted under 35 U.S.C. 154(b) by 157 days.

(21) Appl. No.: 11/337,694

(22) Filed: Jan. 24, 2006

(65) Prior Publication Data

US 2006/0165450 A1 Jul. 27, 2006

(30) Foreign Application Priority Data

Jan. 25, 2005 (JP) ..... 2005-016337

(51) Int. Cl.
*G03G 21/00* (2006.01)

(52) U.S. Cl. ..... 399/346; 399/350; 399/353

(58) Field of Classification Search ..... 399/111, 399/123, 343, 346, 347, 352, 353
See application file for complete search history.

(56) References Cited

U.S. PATENT DOCUMENTS

| | | | |
|---|---|---|---|
| 6,961,529 | B2 | 11/2005 | Kosuge |
| 2004/0136763 | A1 | 7/2004 | Murakami et al. |
| 2004/0141779 | A1 | 7/2004 | Yanagida et al. |
| 2004/0170455 | A1 | 9/2004 | Shintani et al. |
| 2004/0202495 | A1 | 10/2004 | Koike et al. |
| 2004/0213597 | A1 | 10/2004 | Yanagida et al. |
| 2005/0002705 | A1 | 1/2005 | Shintani et al. |
| 2005/0025520 | A1 | 2/2005 | Murakami et al. |
| 2005/0036805 | A1 | 2/2005 | Murakami et al. |
| 2005/0074264 | A1 | 4/2005 | Amemiya et al. |
| 2005/0084271 | A1 | 4/2005 | Koike et al. |
| 2005/0164108 | A1 | 7/2005 | Murakami et al. |
| 2005/0191081 | A1 | 9/2005 | Muraishi et al. |
| 2005/0191574 | A1 | 9/2005 | Koike et al. |
| 2005/0232665 | A1 | 10/2005 | Toshio et al. |
| 2005/0232666 | A1 | 10/2005 | Ojimi et al. |

FOREIGN PATENT DOCUMENTS

| | | |
|---|---|---|
| JP | 2000-75752 | 3/2000 |
| JP | 2002-207397 | 7/2002 |
| JP | 2002-287567 | 10/2002 |
| JP | 2003-241570 | 8/2003 |
| JP | 2003-316201 | 11/2003 |
| JP | 2003-330320 | 11/2003 |
| JP | 2004-309940 | 11/2004 |

*Primary Examiner*—Hoang Ngo
(74) *Attorney, Agent, or Firm*—Oblon, Spivak, McClelland, Maier & Neustadt, P.C.

(57) ABSTRACT

An image forming apparatus includes units for electrostatically charging a surface of an image carrier, exposing the surface according to image data to write a latent image, supplying a toner to the latent image to form a visible image, and transferring the visible image from the surface to another surface. A rotatable brush roller and a cleaning blade in contact with the surface removes remaining toner. Another brush roller rotates and scrapes lubricant to apply the lubricant to the surface. The image forming apparatus has a lubricant consumption of 0.1 gram to 1.2 grams per 1,500 meters of a traveling distance of the image carrier.

10 Claims, 4 Drawing Sheets

IMAGE FORMING APPARATUS, PROCESS CARTRIDGE, AND TONER

CROSS-REFERENCE TO RELATED APPLICATIONS

The present document incorporates by reference the entire contents of Japanese priority document, 2005-016337 filed in Japan on Jan. 25, 2005.

BACKGROUND OF THE INVENTION

1. Field of the Invention

The present invention relates to an electrophotographic image forming apparatus or a process cartridge including a unit that applies a lubricant to the surface of an image carrier, and a toner used in the image forming apparatus or the process cartridge.

2. Description of the Related Art

An image forming apparatus using an electrophotographic process has a photoconductor as an image carrier, and the surface of the photoconductor is electrostatically charged by discharge and the charged surface of the photoconductor is exposed to form an electrostatic latent image, and a toner is supplied to the electrostatic latent image to make the image visible, and the visible image formed on the surface of the photoconductor is transferred to the surface of transfer paper and then fixed and discharged. Some of the toner remains on the surface of the photoconductor after the visible image is transferred, and therefore, for preventing the remaining toner from adversely affecting the next image formation, the surface of the photoconductor is cleaned by a cleaning unit and then subjected to the subsequent image forming process. A generally known cleaning unit having a cleaning blade includes an elastomer, such as a rubber, which is abutted against the surface of the photoconductor to remove deposits including the remaining toner.

There are increasing demands for high-quality images, and particularly, for achieving the formation of high definition color images, a toner having a smaller particle diameter or a spherical shape has been developed. The toner having a smaller particle diameter can improve dot reproductivity, and the toner having a spherical shape can improve the development property and the transfer property. The toner having a smaller particle diameter or a spherical shape is very difficult to produce by a conventional grinding method, and hence a polymerized toner produced by a suspension polymerization method, an emulsion polymerization method, or a dispersion polymerization method is employed.

However, the use of the toner having a spherical shape or a smaller particle diameter causes some problems in cleaning of the photoconductor after the image is formed. One problem is that the toner having a spherical shape or a smaller particle diameter is difficult to remove by a blade cleaning method generally employed. A cleaning blade, which is rubbed against the surface of the photoconductor to remove the toner from the photoconductor, is deformed at its edge by the frictional resistance of the photoconductor, causing a very small gap between the photoconductor and the cleaning blade; The smaller the particle diameter of the toner, the more likely the toner is brought into the gap. When the toner brought into the gap is spherical or substantially spherical, the frictional force by rolling is smaller and causes the toner to roll through the gap between the photoconductor and the cleaning blade, so that the toner passes under the cleaning blade. When a large amount of the toner passes under the cleaning blade, the cleaning for the photoconductor becomes unsatisfactory, leading to a defective image suffering from, for example, background fogging.

Another problem is that a lubricating agent or a superplasticizer contained in the toner, which passes under the cleaning blade and then remains on the surface of the photoconductor, forms a film material sticking to the surface of the photoconductor, i.e., so-called filming occurs. The occurrence of filming causes a defective image with, for example, unprinted points in the solid area of image.

For improving the cleaning property for the surface of the photoconductor when using the toner having a spherical shape or a smaller particle diameter, a method has been proposed in which a lubricant includes, for example, a metal salt of a fatty acid is applied to the surface of the photoconductor to form a thin film, lowering the friction coefficient of the surface of the photoconductor, for example, as disclosed in Japanese Patent Application Laid-open No. 2002-287567. It has already been found that, when the friction coefficient of the surface of the photoconductor is low, the adhesive force between the photoconductor and the toner is small and hence cleaning by the blade becomes effective, thus preventing the occurrence of filming.

When the friction coefficient of the photoconductor is not satisfactorily lowered, the toner is likely to pass through the cleaning unit to cause a cleaning failure or filming is likely to occur on the surface of the photoconductor. When filming by the lubricating agent or superplasticizer contained in the toner occurs, the resultant film material is difficult to remove by the cleaning blade.

Especially, the developer in the developing unit includes large amounts of a lubricating agent, a superplasticizer, and the like derived from the toner, and hence filming is likely to occur immediately on the photoconductor coated with the lubricant only with a small coating amount. Therefore, it is necessary to constantly apply the lubricant to the photoconductor in an appropriate coating weight during the life of the photosensitive unit.

On the other hand, when the friction coefficient of the surface of the photoconductor is too small, other problems arise. One of the problems is such that the adhesive force between the photoconductor and the toner is lowered and therefore a satisfactory amount of the toner is not transferred from a development roller to the electrostatic latent image formed on the photoconductor in the development step, thus causing unprinted portions in the image or a low-density image, for example, as disclosed in Japanese Patent Application Laid-open Nos. 2002-287567 and 2002-207397.

Japanese Patent Application Laid-open No. 2000-75752 includes a description that a shape factor SF1 is 100 to 150, a cleaning unit has an elastic blade abutted at a linear pressure of 55 g/cm to 105 g/cm, and a lubricant application mechanism applies at least 0.4 gram or more of a lubricant until a rotation distance of an image carrier to be coated becomes 525 meters. When the linear pressure of the cleaning blade is high, the blade disadvantageously scrapes the lubricant from the image carrier to lower the application efficiency, so that the photoconductor CTL layer is considerably quick to wear. By surely applying a lubricant in an appropriate coating weight constantly during the life of the photosensitive unit, excellent images can be provided stably.

SUMMARY OF THE INVENTION

It is an object of the present invention to at least solve the problems in the conventional technology.

An image forming apparatus includes an image carrier that carries a latent image, a charging unit that electrostatically charges a surface of the image carrier, an exposure unit that subjects electrostatically charged surface of the image carrier to exposure according to image data to write a latent image on the surface, a developing unit that supplies a toner to the latent image formed on the surface of the image carrier to visualize the latent image into a visible,image, a transfer unit that transfers the visible image from the surface of the image carrier to another surface, a cleaning unit, being in contact with the surface of the image carrier, that removes the toner remaining on the surface of the image carrier by a rotatable brush roller and a cleaning blade placed downstream of the brush roller, and a lubricant applying unit that includes a lubricant and a brush roller, wherein the brush roller rotates and scrapes the lubricant to apply the lubricant to the surface of the image carrier, wherein the image forming apparatus has a lubricant consumption of 0.1 gram to 1.2 grams per 1,500 meters of a traveling distance of the image carrier.

The other objects, features, and advantages of the present invention are specifically set forth in or will become apparent from the following detailed description of the invention when read in conjunction with the accompanying drawings.

DETAILED DESCRIPTION OF THE PREFERRED EMBODIMENTS

Exemplary embodiments of the present invention will be described below with reference to accompanying drawings. The present invention is not limited to these embodiments.

Figure 1:
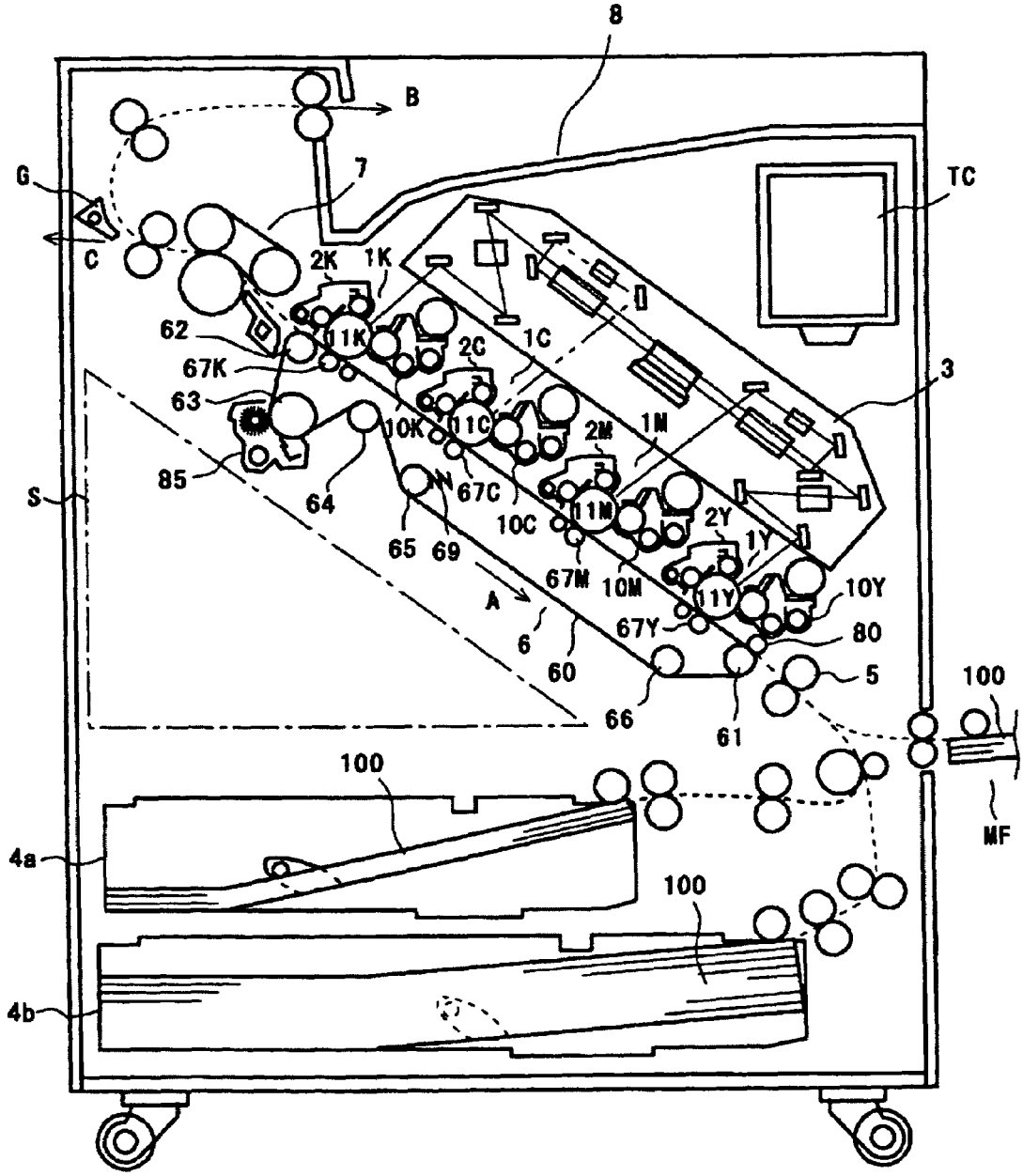
FIG. 1 is a schematic of an image forming apparatus according to an embodiment of the present invention.
Figure 2:
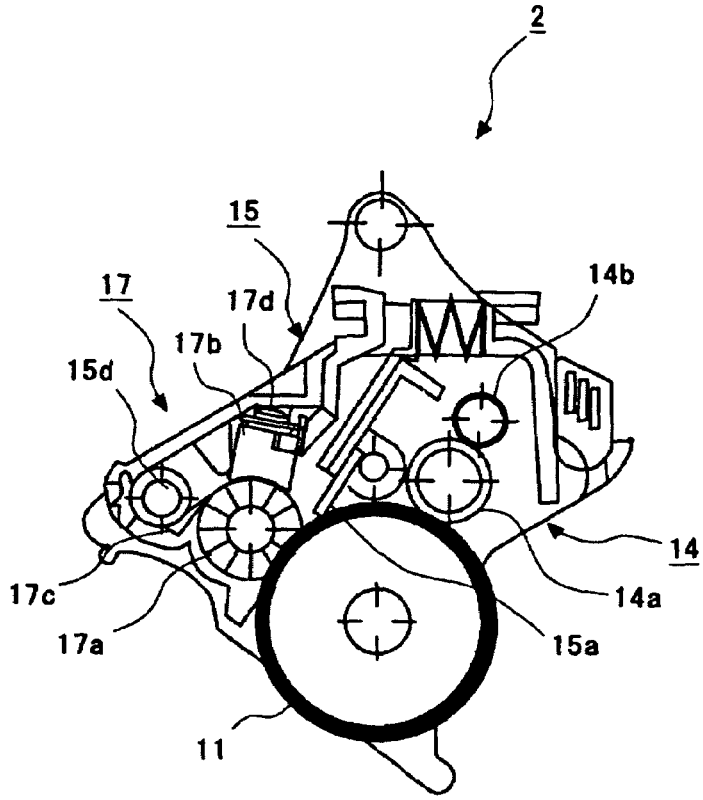
FIG. 2 is a schematic of a photosensitive unit according to the embodiment of the present invention.

FIG. 1 is a schematic of an image forming apparatus according to an embodiment of the present invention, and FIG. 2 is a schematic of a photosensitive unit.

The image forming apparatus includes four image forming units 1Y, 1M, 1C, 1K that forms yellow (Y), magenta (M), cyan (C), and black (K) images, respectively. The order of the colors for Y, M, C, and K is not limited to that shown in FIG. 1, and can be arbitrary changed.

The image forming units 1Y, 1M, 1C, 1K have, respectively, photosensitive drums 1Y, 1M, 1C, 1K as image carriers, an electrostatic charging unit, a developing unit, and a cleaning unit. The image forming units 1Y, 1M, 1C, 1K are disposed at a predetermined pitch in a traveling direction of transfer paper, so that the rotating shafts of the respective photosensitive drums are parallel to one another.

An optical writing unit 3 is disposed above the image forming units 1Y, 1M, 1C, 1K, wherein the optical writing unit has a light source, a polygon mirror, an f-θ lens, a reflection mirror, and the like and scans with a laser beam over the surfaces of the photosensitive drums 11Y, 11M, 11C, 11K according to the image data, and a transfer unit 6 is disposed under the image forming units 1Y, 1M, 1C, 1K, wherein the transfer unit serves as a belt driving machine having a transfer conveyor belt 60 that carries and conveys the transfer paper so that it passes through the transfer portion in each of the image forming units. A cleaning device 85 including a brush roller and a cleaning blade is disposed such that it is in contact with the outer surface of the transfer conveyor belt 60. The cleaning device 85 removes foreign matters including the toner adhering to the transfer conveyor belt 60.

A fixing unit 7 of a belt fixing method, a delivery tray 8, and the like are disposed on one side of the transfer unit 6. The image forming apparatus has, in its lower portion, paper feed cassettes 4*a*, 4*b* containing transfer paper 100. Furthermore, the image forming apparatus has a manual feed tray MF on its side through which paper is manually fed.

In addition, a toner supply container TC is provided, and a waste toner bottle, a duplex/reversal unit, a power source unit (they are not shown), and the like are provided in a space S indicated by a dot-dash line.

The developing devices 10Y, 10M, 10C, 10K as developing units have the same configuration, and they are the developing devices 10Y, 10M, 10C, 10K of a binary development method in which only the colors of toner used are different, and each of them contains therein a developer including a toner and a magnetic carrier.

Each of the developing devices 10Y, 10M, 10C, 10K includes a development roller facing each photosensitive drum 11, a screw that moves and agitates the developer, a toner density sensor, and the like. The development roller includes a rotary sleeve disposed on the outer side of the roller and a magnet fixed on the inner side of the roller. A toner supply device supplies a toner according to the output of the toner density sensor.

Photosensitive units 2Y, 2M, 2C, 2K have the same configuration, and, as shown in FIG. 2, a photosensitive unit 2 includes the photosensitive drum 11 on which an electrostatic latent image is formed, an electrostatic charging device 14, a cleaning device 15, and a lubricant applying unit 17.

The electrostatic charging device 14 has a charging roller 14*a* including a conductive core metal as a charged member covered with a medium-resistant elastic layer. The charging roller 14*a* is connected to a power source (not shown), which applies a predetermined voltage to the roller. The charging roller 14*a* has a pressure spring as a pressing member that presses both the ends toward the photosensitive drum 11. The charging roller 14*a* and the photosensitive drum 11 can be disposed such that either they are in contact with each other, or they leave a very small gap therebetween. While the very small gap is not shown, it can be formed by winding a spacer member having a predetermined thickness around the non-image formation areas at both the ends of the charging roller 14*a*, so that the surface of the spacer member is abutted against the surface of the photosensitive drum 11.

A charged cleaning roller 14*b* is disposed such that it is abutted against the side of the charging roller 14*a* opposite the side of the charging roller 14*a* facing the photosensitive drum 11. The charged cleaning roller 14*b* is a unit that removes contaminants from the charging roller 14*a*, This unit is formed by, for example, spirally winding a resin foam around a core metal.

The cleaning device 15 has a cleaning blade 15*a* and a cleaning brush 17*a* that removes transfer residue toner remaining on the surface of the photosensitive drum 11. A scraper 17*c* that removes the toner adhering to the brush fiber is abutted against the cleaning brush 17*a*. The toner scraped by the cleaning blade 15*a* is shifted by the cleaning brush 17*a* toward a toner carrier auger 15*d*, and the toner carrier auger 15*d* is rotated to shift the collected waste toner to a waste toner container (not shown).

It is desired that the cleaning blade 15*a* is abutted against the photosensitive drum 11 at a linear pressure of 0.1 to 0.5 N/cm. When the linear pressure is lower than 0.1 N/cm, the transfer residue toner and the like cannot be scraped. On the other hand, when the linear pressure is higher than 0.5 N/cm, the frictional force between the cleaning blade and the photosensitive drum 11 is too large, so that blade peeling or bounding is likely to occur. Furthermore, the vibration of the blade causes squeal, or a cleaning failure, such as forming of chatter marks, occurs.

The lubricant applying unit 17 includes a lubricant shaped article 17*b*, a brush roller 17*a*, being in contact with the lubricant shaped article 17*b*, that scrapes a lubricant and applies the lubricant to the surface of the photosensitive drum 11, a brush roller scraper 17*c* that removes the toner adhering to the brush roller 17*a*, and a pressure spring 17*d* that presses the lubricant shaped article 17*b* against the brush roller 17*a* at a predetermined pressure.

The lubricant shaped article 17*b* is a block shaped article formed from zinc stearate. The brush roller 17*a* has a form extending in the direction of the shaft of the photosensitive drum 11. The pressure spring 17*d* is pressed against the brush roller 17*a* so that substantially the entire lubricant shaped article 17*b* can be completely consumed. The lubricant shaped article 17*b* is expendable and hence reduced in thickness as a period of time lapses, however, it is pressed by the pressure spring 17*d* and always abutted against the brush roller 17*a* to scrape a lubricant from the lubricant shaped article 17*b* and supply and apply the lubricant to the photosensitive drum 11. The brush roller 17*a* functions also as a cleaning brush, which moves the toner removed by the cleaning blade 15*a* toward the toner carrier auger 15*d*.

The configuration of the lubricant applying unit 17 is not limited to the configuration mentioned above, and it can be a configuration such that the lubricant shaped article 17*b* is directly abutted against the surface of the photosensitive drum 11 to apply a lubricant to the photosensitive drum or a powdery lubricant is supplied to the surface of the photosensitive drum 11, and the lubricant applying unit preferably includes the lubricant shaped article 17*b* and brush roller 17*a* as units that can more efficiently control the coating weight of the lubricant on the surface of the photosensitive drum 11. Examples of lubricants for the lubricant shaped article 17*b* include metal salts of fatty acids, such as lead oleate, zinc oleate, copper oleate, zinc stearate, cobalt stearate, iron stearate, copper stearate, zinc palmitate, copper palmitate, and zinc linolenate; and fluororesins, such as polytetrafluoroethylene, polychlorotrifluoroethylene, polyvinylidene fluoride, polytrifluorochloroethylene, dichlorodifluoroethylene, tetrafluoroethylene-ethylene copolymers, and tetrafluoroethylene-oxafluoropropylene copolymers. Especially preferred is a metal salt of stearic acid that can considerably effectively lower the friction of a photoconductor 5, and further preferred is zinc stearate.

It is preferred that the lubricant shaped article 17*b* is pressed against the brush roller 17*a*, and it is preferred that the pressure including its own weight is 200 millinewtons or more by a pressure spring. When the pressure is lower than 200 millinewtons, the lubricant consumption does not reach 0.1 gram or more per 1,500 meters of a traveling distance of the photoconductor. The higher the pressure, the larger the amount of the lubricant scraped off the lubricant shaped article 17*b* by the brush roller 17*a*, i.e., the larger the coating weight of the lubricant on the surface of the photosensitive drum 11. When the pressure is too high, an excess amount of the lubricant is supplied to the surface of the photosensitive drum 11 and thus the friction coefficient is excessively lowered, and further the consumption of the lubricant shaped article 17*b* becomes considerably large or the lubricant shaped article suffers a damage, and therefore it is preferred that the pressure is not higher than 4,000 millinewtons.

The operation of forming an image by the image forming apparatus having the above configuration is as follows.

First, a predetermined voltage is applied to the charging roller 14*a* from a power source (not shown) to electrostatic charge the surface of the photosensitive drum 11 facing the charging roller. Subsequently, the optical writing unit 3 scans with a laser beam according to the image data over the surface of the photosensitive drum 11 charged to the predetermined potential to write an electrostatic latent image on the photosensitive drum. The surface of the photosensitive drum 11 having an electrostatic latent image carried thereon reaches a developing device 10, and then the development roller facing the photosensitive drum 11 supplies a toner to the electrostatic latent image on the surface of the photosensitive drum 11 to form a toner image.

The similar operation is performed in each of the photosensitive units 2Y, 2M, 2C, 2K with a predetermined timing to form toner images with respectively predetermined colors on the respective surfaces of the photosensitive drums 11Y, 11M, 11C, 11K.

The transfer paper 100 is fed from any one of the paper feed cassettes 4*a*, 4*b* and the manual feed tray MF, and temporary stopped when it arrives at the resist roller 5. The transfer paper 100 is then fed by the resist roller with timing of the operation for forming images in the photosensitive units 2Y, 2M, 2C, 2K, and the toner images on the photosensitive drums 11 are successively transferred to the transfer paper being conveyed by the transfer conveyor belt 60. The transfer of the toner images to the transfer paper is conducted by application of a voltage having polarity contrary to the polarity of the toner on the photosensitive drum 11 by a power source (not shown) from primary transfer rollers 67Y, 67M, 67C, 67K facing the photosensitive drums 11Y, 11M, 11C, 11K, respectively, through the transfer conveyor belt 60.

The transfer paper 100 is passed through the position facing the photosensitive drum 11K, wherein all the toner images with four colors have been put on the transfer paper 100, and subsequently fed to the fixing unit 7 so that the images are fixed by heat and pressure.

On the other hand, after transfer of the toner image, at the facing surfaces of the lubricant applying unit 17 and the cleaning device 15, the surface of the photosensitive drum 11 is coated with zinc stearate as a lubricant by the brush roller 17*a*, and the toner remaining on the surface of the photosensitive drum 11 is removed by the cleaning blade 15*a*, and thus the photosensitive drum is ready for the subsequent operation for forming images.

At this time, the cleaning blade 15*a* abrades the surface of the photosensitive drum 11 and hence, the zinc stearate applied by the brush roller 17*a* is uniformly spread to form a thin film, covering the surface of the photosensitive drum 11. By forming the thin film of zinc stearate on the surface of the photosensitive drum 11, the friction coefficient of the surface of the photosensitive drum 11 can be lowered, thus improving the transfer property of the developed toner and the cleaning property for untransferred residual toner.

In the image forming apparatus according to the embodiment of the present invention, for forming images with high quality and high definition, the toner used in the developing device 10 has an average degree of circularity equal to or more than 0.93.

The average degree of circularity of the toner is a value obtained by dividing the optically detected particle by the circumference of the corresponding circle having the same projected area. Specifically, the average degree of circularity is measured using Flow particle image analyzer (FPIA-2000; SYSMEX CORPORATION). 100 to 150 milliliters of water, from which impurity solids are preliminarily removed, is placed in a predetermined container, and 0.1 to 0.5 milliliter of a surfactant as a dispersant is added to the water and further about 0.1 to 9.5 grams of a sample for measurement is added. The resultant suspension having the sample dispersed therein is subjected to dispersion treatment by an ultrasonic dispersion mixer for about 1 to 3 minutes so that the dispersion concentration becomes dispersed particles of 3,000 to 10,000/μl, followed by measurement of the shape and distribution of toner.

A toner having high average degree of circularity is used as mentioned above, and thus the present image forming apparatus employs conditions such that the tolerance of cleaning is small. Therefore, it is important that a thin film of zinc stearate is advantageously formed on the surface of the photosensitive drum 11 on the early stage of the photosensitive unit.

Figure 3:
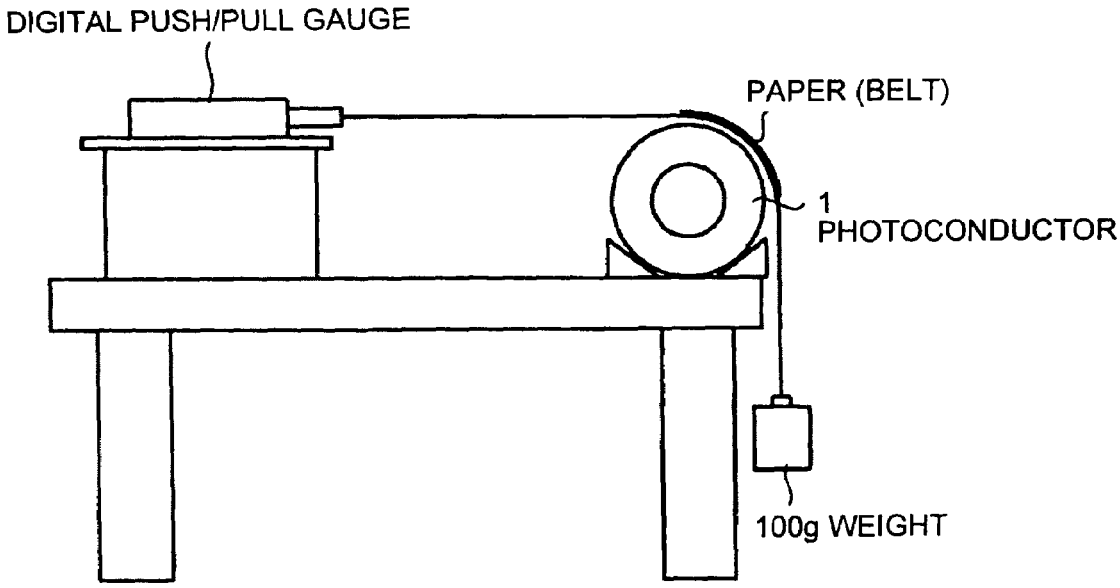
FIG. 3 is a schematic of a friction coefficient measurement apparatus in which an oiler belt method is used for measuring friction coefficients of a photoconductor according to the embodiment of the present invention.

The measurement of the friction coefficient of the photoconductor employs an oiler belt method, and FIG. 3 is a schematic of a friction coefficient measurement apparatus. The friction coefficient measurement apparatus is of an oiler belt method, and wood free paper having a medium thickness as a belt is put on the photoconductor drum so that the paper is in contact with ¼ of the circumference of the photoconductor drum and the machine direction of the paper is aligned with the longitudinal direction, and a weight of, for example, 0.98 newton (100 grams) is put to one end of the belt, and a force gauge is set at another end of the belt, and the force gauge is elongated and a load is read at a point in time when the belt is moved, and applied to the formula: Friction coefficient $\mu s=2/\pi\times 1n\ (F/0.98)$($\mu$: static coefficient of friction; and F: measured value) to determine a friction coefficient.

The constituent materials of the toner and the method for producing the toner are explained below in detail.

A suspension polymerization method is performed as follows. A coloring agent, a lubricating agent, and the like are dispersed in an oil-soluble polymerization initiator and polymerizable monomers, and the resultant dispersion is emulsified in an aqueous medium containing a surfactant, a solid dispersant, and the like by the emulsifying method explained below. The resultant emulsion is then subjected to polymerization reaction to form particles, followed by the following surface treatment for the toner particles.

An emulsion polymerization-coagulation method is performed as follows. A water-soluble polymerization initiator and polymerizable monomers are emulsified in water using a surfactant and subjected to general emulsion polymerization to synthesize a latex. Separately, a dispersion including a coloring agent, a lubricating agent, and the like dispersed in an aqueous medium is prepared, and mixed with the synthesized latex, and then allowed to undergo coagulation so that the particles have a toner size and fused together by heat, obtaining a toner. The toner is then subjected to the following surface treatment for the toner particles.

A polymer suspension method is performed as follows. As an aqueous medium, water can be solely used, however, water and a solvent miscible with water can be used in combination. Examples of solvents miscible with water include alcohols (such as methanol, isopropanol, and ethylene glycol), dimethylformamide, tetrahydrofuran, cellosolves (such as methyl cellosolve), and lower ketones (such as acetone and methyl ethyl ketone).

As an oil phase including a toner composition, a resin, a prepolymer, a coloring agent, such as a pigment, a lubricating agent, a charge controlling agent, and the like are dissolved or dispersed in a volatile solvent.

The oil phase including the toner composition is dispersed in an aqueous medium in the presence of a surfactant, a solid dispersant, and the like so that the prepolymer undergoes a reaction to form particles. The particles are then subjected to the following surface treatment for the toner particles.

A method for surface treatment is performed as follows. With respect to each of the above methods for producing a toner, the particles in liquid can be subjected to surface treatment for imparting a charge controlling property to the particles. It is preferred that this step is conducted after the surfactant used and the like are removed by washing from the toner particles formed in an aqueous medium. An excess surfactant present in an aqueous medium is removed by an operation of solid-liquid separation, such as filtration or centrifugal separation, and the resultant cake or slurry is dispersed again in an aqueous medium.

An aqueous solution of a surfactant having polarity contrary to the polarity of the surface of the toner particles is added dropwise to the dispersion while stirring. The surfactant having such polarity can be used in an amount of 0.01 to 1% by weight, based on the solids weight of the toner particles.

The polarity of the surface of the toner particles can be affected by the surfactant used. Specifically, in the above process for forming toner particles, the surfactant present in an aqueous medium has high affinity with polymerizable monomers or an organic solvent and hence is likely to remain on the surface of the toner particles, and thus the polarity of the surfactant causes the polarity of the surface of the toner particles.

On the other hand, in the polymer suspension method, a resin having a low molecular weight is used to reduce the viscosity of the dispersed phase, facilitating emulsifying, and further the resin emulsified is permitted to undergo any one of crosslinking and extension reaction or both inside the emulsion particles, thus producing particles including a resin having a high molecular weight. In this case, the polarity of the polymer obtained by any one of crosslinking and extension reaction or both causes the polarity of the surface of the toner particles.

The polar substance present on the surface of the toner particles can cause the toner to have an unstable electrostatic property. However, by treating the surface of the toner particles with a surfactant having polarity contrary to the polarity of the surface of the toner particles as mentioned above, adverse effects on the toner electrostatic property can be blocked.

As a compound containing fluorine that is a surfactant having polarity contrary to the polarity of the surface of the toner particles, the following compounds can be preferably used. When the compound containing fluorine is present on the surface of the toner particles, a toner having both an ability to be negatively charged stably and excellent charge rising property can be obtained.

A fluorine surfactant is described below. Examples of anionic surfactants having a fluoroalkyl group preferably used include fluoroalkylcarboxylic acids having 2 to 10 carbon atoms and metal salts thereof, disodium perfluorooctanesulfonylglutamate, sodium 3-[omega-fluoroalkyl($C_6$-$C_{11}$)oxy]-1-alkyl($C_3$-$C_4$) sulfonate, sodium 3-[omega-fluoroalkanoyl($C_6$-$C_8$)-N-ethylamino]-1-propanesulfonate, fluoroalkyl($C_{11}$-$C_{20}$)carboxylic acids and metal salts thereof, perfluoroalkylcarboxylic acids ($C_7$-$C_{13}$) and metal salts thereof, perfluoroalkyl($C_4$-$C_{12}$)sulfonic acid and metal salts thereof, perfluorooctanesulfonic acid diethanolamide, N-propyl-N-(2-hydroxyethyl)perfluorooctanesulfonamide, propyltrimethylammonium salts of perfluoroalkyl($C_6$-$C_{10}$) sulfonamide, perfluoroalkyl($C_6$-$C_{10}$)-N-ethylsulfonylglycine salts, and monoperfluoroalkyl($C_6$-$C_{16}$) ethyl phosphate.

Examples of trade names for the above include Surflon S-111, S-112, and S-113 (Asahi Glass Co., Ltd.), Fluorad FC-93, FC-95, FC-98, and FC-129 (Sumitomo 3M), Unidyne DS-101 and DS-102 (DAIKIN INDUSTRIES, Ltd.), Megafac F-110, F-120, F-113, F-191, F-812, and F-833 (Dainippon Ink & Chemicals Incorporated), Ectop EF-102, 103, 104, 105, 112, 123A, 123B, 306A, 501, 201, and 204 (Tohchem Products Co., Ltd.), and FTERGENT F-100 and F150 (NEOS COMPANY LIMITED).

Examples of cationic surfactants include aliphatic primary, secondary, or secondary amine acids having a fluoroalkyl group, aliphatic quaternary ammonium salts, such as propyltrimethylammonium salts of perfluoroalkyl($C_6$-$C_{10}$) sulfonamide, benzarconium salts, benzethonium chloride, pyridinium salts, and imidazolinium salts, and examples of trade names for the cationic surfactants include Surflon S-121 (Asahi Glass Co., Ltd.), Fluorad FC-135 (Sumitomo 3M), Unidyne DS-202 (DAIKIN INDUSTRIES, Ltd.), Megafac F-150, F-824 (Dainippon Ink & Chemicals Incorporated), Ectop EF-132 (Tohchem Products Co., Ltd.), and FTERGENT F-300 (NEOS COMPANY LIMITED).

Especially when a fluorine-containing quaternary ammonium salt compound represented by the general formula (1) below is used, there can be obtained a stable developer having a charge amount unlikely to change even when the environment changes.

(1)

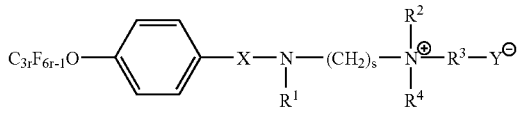

where

X represents —$SO_2$— or —CO—;

each of $R^1$, $R^2$, $R^3$, and $R^4$ represents a hydrogen atom, a lower alkyl group having 1 to 10 carbon atoms, or an aryl group;

Y represents I or Br; and each of r and s represents an integer of 1 to 20.

For improving the electrostatic property, dispersed resin particles can be further added to the slurry dispersed again. By adding a surfactant having polarity contrary to the polarity of the resin particles, the charge of the dispersed resin particles in water is cancelled out, making it possible to allow the resin particles to adhere by coagulation to the surface of the toner particles. The resin particles can be used in an amount of 0.01 to 5% by weight, based on the solids weight of the toner particles.

As the charge controlling resin particles, those conventionally known can be used, however, preferred are polymer particles, for example, dispersed resin particles obtained by soap-free emulsion polymerization, suspension polymerization, or dispersion polymerization. Especially preferred examples include polystyrene copolymerized with a monomer having a carboxyl group, such as methacrylic acid, polymer particles obtained by copolymerizing a fluorine-containing methacrylic ester or fluorine-containing acrylic ester during emulsion polymerization or dispersion polymerization, polycondensation polymers, such as silicone, benzoguanamine, and nylon, and polymer particles comprised of a thermosetting resin.

The charge controlling agent particles or resin particles adhering to the surface of the toner are then fixed to the surface of the toner by heating the slurry, so that they can be prevented from leaving the toner. At this time, it is desired that the particles are heated to a temperature higher than the Tg of the resin constituting the toner. The heating treatment can be performed after drying.

The base particles of the toner according to the embodiment of the present invention are produced, for example, from the following raw materials and by the following method.

A modified polyester is described below. The toner according to the embodiment of the present invention includes modified polyester (i) as a binder resin. The modified polyester (i) means a polyester resin containing an ester linkage and another linkage group, or a polyester resin having another resin component bonded thereto through a covalent bond or an ionic bond. Specifically, it means a resin obtained by introducing a functional group capable of reacting with a carboxylic acid group or a hydroxyl group, for example, an isocyanate group into the end of polyester, and further reacting the polyester with an active hydrogen-containing compound to modify the end of polyester.

Examples of modified polyesters (i) include urea-modified polyesters obtained by reacting polyester prepolymer (A) having an isocyanate group with amine (B). Examples of polyester prepolymers (A) having an isocyanate group include ones obtained by reacting polyester, which is a polycondensation product of polyol (PO) and polycarboxylic acid (PC) and which has an active hydrogen group, with polyisocyanate compound (PIC). Examples of active hydrogen groups contained in the polyester include a hydroxyl group (such as an alcoholic hydroxyl group and a phenolic hydroxyl group), an amino group, a carboxyl group, and a mercapto group, and, among these, preferred is an alcoholic hydroxyl group.

The urea-modified polyester is formed as follows.

Examples of polyol compounds (PO) include diols (DIO) and tri- or polyols (TO), and a (DIO) or a mixture of a (DIO) and a small amount of a (TO) is preferred. Examples of diols (DIO) include alkylene glycols (such as ethylene glycol, 1,2-propylene glycol, 1,3-propylene glycol, 1,4-butanediol, and 1,6-hexanediol); alkylene ether glycols (diethylene glycol, triethylene glycol, dipropylene glycol, polyethylene glycol, polypropylene glycol, and polytetramethylene ether glycol); alicyclic diols (such as 1,4-cyclohexanedimethanol and hydrogenated bisphenol A); bisphenols (such as bisphenol A, bisphenol F, and bisphenol S); alkylene oxide (such as ethylene oxide, propylene oxide, or butylene oxide) addition products of the above alicyclic diol; and alkylene oxide (such as ethylene oxide, propylene oxide, or butylene oxide) addition products of the above bisphenol. Among these, preferred are alkylene oxide addition products of alkylene glycol having 2 to 12 carbon atoms or bisphenol, and especially preferred are combinations of an alkylene oxide addition product of bisphenol and an alkylene glycol having 2 to 12 carbon atoms. Examples of tri- or polyols (TO) include tri- to octahydric and polyhydric aliphatic alcohols (such as glycerol, trimethylolethane, trimethylolpropane, pentaerythritol, and sorbitol); triphenols and polyphenols (such as trisphenol PA, phenolic novolak, and cresol novolak); and alkylene oxide addition products of the above triphenol or polyphenol.

Examples of polycarboxylic acids (PC) include dicarboxylic acids (DIC) and tri- or polycarboxylic acids (TC), and a (DIC) or a mixture of a (DIC) and a small amount of a (TC) is preferred. Examples of dicarboxylic acids (DIC) include alkylenedicarboxylic acids (such as succinic acid, adipic acid, and sebacic acid); alkenylenedicarboxylic acids (such as maleic acid and fumaric acid); and aromatic dicarboxylic acids (such as phthalic acid, isophthalic acid, terephthalic acid, and naphthalenedicarboxylic acid). Among these, preferred are alkenylenedicarboxylic acids having 4 to 20 carbon atoms and aromatic dicarboxylic acids having 8 to 20 carbon atoms. Examples of tri- or polycarboxylic acids (TC) include aromatic polycarboxylic acids having 9 to 20 carbon atoms (such as trimellitic acid and pyromellitic acid). An anhydride or a lower alkyl ester (such as a methyl ester, an ethyl ester, or an isopropyl ester) of the above acid can be used as polycarboxylic acid (PC) and reacted with polyol (PO).

The ratio of the polyol (PO) to the polycarboxylic acid (PC) is generally 2/1 to 1/1, preferably 1.5/1 to 1/1, further preferably 1.3/1 to 1.02/1, in terms of an equivalent ratio of the hydroxyl group [OH] to the carboxyl group [COOH], i.e., [OH]/[COOH].

Examples of polyisocyanate compounds (PIC) include aliphatic polyisocyanate (such as tetramethylene diisocyanate, hexamethylene diisocyanate, and 2,6-diisocyanatomethyl caproate); alicyclic polyisocyanate (such as isophorone diisocyanate and cyclohexylmethane diisocyanate); aromatic diisocyanate (such as tolylene diisocyanate and diphenylmethane diisocyanate); aromatic aliphatic diisocyanate (such as $\alpha,\alpha,\alpha',\alpha'$-tetramethylxylylene diisocyanate); isocyanates; compounds obtained by blocking the above polyisocyanate with a phenol derivative, oxime, or caprolactam; and mixtures thereof.

The ratio of the polyisocyanate compound (PIC) to the polyester is generally 5/1 to 1/1, preferably 4/1 to 1.2/1, further preferably 2.5/1 to 1.5/1, in terms of an equivalent ratio of the isocyanate group [NCO] to the hydroxyl group [OH] in the polyester having a hydroxyl group, i.e., [NCO]/[OH]. When the [NCO]/[OH] is more than 5, the low-temperature fixing property becomes poor. When the [NCO] molar ratio is less than 1, the urea content of the urea-modified polyester used is too small, so that the hot offset resistance becomes poor.

The content of the constituents of polyisocyanate compound (PIC) in polyester prepolymer (A) having an isocyanate group is generally 0.5 to 40% by weight, preferably 1 to 30% by weight, further preferably 2 to 20% by weight. When the content is less than 0.5% by weight, not only be the hot offset resistance poor, but also it is difficult to achieve both excellent resistance to high temperature storage and excellent low-temperature fixing property. On the other hand, when the content is more than 40% by weight, the low-temperature fixing property becomes poor.

The number of isocyanate groups contained in one molecule of polyester prepolymer (A) having an isocyanate group is generally one or more, preferably 1.5 to 3 on average, further preferably 1.8 to 2.5 on average. When the number of isocyanate groups is less than one per one molecule of the polyester prepolymer, the resultant urea-modified polyester has too small a molecular weight, so that the hot offset resistance becomes poor.

Examples of amines (B) to be reacted with polyester prepolymer (A) include diamine compounds (B1), tri- or polyamine compounds (B2), amino alcohols (B3), aminomercaptans (B4), amino acids (B5), and amines (B6) obtained by blocking the amino group in any one of B1 to B5.

Examples of diamine compounds (B1) include aromatic diamines (such as phenylenediamine, diethyltoluenediamine, and 4,4'-diaminodiphenylmethane); alicyclic diamines (4,4'-diamino-3,3'-dimethyldicyclohexylmethane, diaminocyclohexane, and isophorone diamine); and aliphatic diamines (such as ethylenediamine, tetramethylenediamine, and hexamethylenediamine). Examples of tri- or polyamine compounds (B2) include diethylenetriamine and triethylenetetramine. Examples of amino alcohols (B3) include ethanolamine and hydroxyethylaniline. Examples of aminomercaptans (B4) include aminoethylmercaptan and aminopropylmercaptan. Examples of amino acids (B5) include aminopropionic acid and aminocaproic acid. Examples of amines (B6) obtained by blocking the amino group in any one of B1 to B5 include ketimine compounds obtained from the amine of any one of B1 to B5 and a ketone (such as acetone, metyl ethyl ketone, or methyl isobutyl ketone), and oxazolidine compounds. Among these amines (B), preferred are a B1 and a mixture of a B1 and a small amount of a B2.

The ratio of the polyester to the amine (B) is generally 1/2 to 2/1, preferably 1.5/1 to 1/1.5, further preferably 1.2/1 to 1/1.2, in terms of an equivalent ratio of the isocyanate group [NCO] contained in polyester prepolymer (A) having an isocyanate group to the amino group [NHx] contained in amine (B), i.e., [NCO]/[NHx]. When the [NCO]/[NHx] is more than 2 or less than ½, the resultant urea-modified polyester has too small a molecular weight, so that the hot offset resistance becomes poor.

The urea-modified polyester can contain a urethane linkage as well as a urea linkage. The (urea linkage content)/(urethane linkage content) molar ratio is generally 100/0 to 10/90, preferably 80/20 to 20/80, further preferably 60/40 to 30/70, When the urea linkage molar ratio is less than 10%, the hot offset resistance is poor.

Modified polyester (i) used in the embodiment of the present invention is prepared by a one-shot process or a prepolymer process. Modified polyester (i) generally has a weight average molecular weight of 10,000 or more, preferably 20,000 to 10,000,000, further preferably 30,000 to 1,000,000, The peak molecular weight in the weight average molecular weight of the modified polyester is preferably 1,000 to 10,000, and, when the peak molecular weight is less than 1,000, an extension reaction is unlikely to proceed and the resultant toner has lowered elasticity, so that the hot offset resistance becomes poor. On the other hand, when the peak molecular weight is larger than 10,000, the fixing property becomes poor, and problems of the production, for example, forming particles or grinding are caused. With respect to the number average molecular weight of modified polyester (i), there is no particular limitation when the following unmodified polyester (ii) is used, and it can be a number average molecular weight that can easily produce modified polyester having a weight average molecular weight in the above range. When modified polyester (i) is solely used, modified polyester (i) generally has a number average molecular weight of 20,000 or less, preferably 1,000 to 10,000, further preferably 2,000 to 8,000, When the number average molecular weight of the modified polyester is larger than 20,000, the low-temperature fixing property and the gloss obtained when used in a full color copying machine become poor.

In any one of the crosslinking and the extension reaction or both of polyester prepolymer (A) and amine (B) for obtaining modified polyester (i), if necessary, a reaction terminator can be used to control the molecular weight of the urea-modified polyester obtained. Examples of reaction terminators include monoamines (such as diethylamine, dibutylamine, butylamine, and laurylamine), and blocked products thereof (ketimine compounds).

An unmodified polyester is described below. In the embodiment of the present invention, either the modified polyester (i) can be solely used, or a combination of modified polyester (i) and unmodified polyester (ii) can be used as a binder resin component. When modified polyester (i) and unmodified polyester (ii) are used in combination, the low-temperature fixing property and the gloss obtained when used in a full color copying machine are advantageously improved, as compared to those obtained when modified polyester (i) is solely used. Examples of unmodified polyesters (ii) include polycondensation products of polyol (PO) and polycarboxylic acid (PC) that are similar to the polyester constituents of the modified polyester (i), and preferred examples are similar to the corresponding preferred examples in modified polyester (i). Unmodified polyester (ii) can be either polyester that is unmodified or polyester that is modified with a chemical bond other than the urea linkage, for example, which is modified with a urethane linkage. From the viewpoint of obtaining excellent low-temperature fixing property and excellent hot offset resistance, it is preferred that polyesters (i) and (ii) are at least partially compatible with each other. Therefore, it is preferred that the polyester component of (i) and unmodified polyester (ii) have the similar composition. When unmodified polyester (ii) is used, the (i)/(ii) weight ratio is generally 5/95 to 80/20, preferably 5/95 to 30/70, further preferably 5/95 to 25/75, especially preferably 7/93 to 20/80, When the (i) weight ratio is less than 5%, not only be the hot offset resistance poor, but also it is difficult to achieve both excellent resistance to high temperature storage and excellent low-temperature fixing property.

Unmodified polyester (ii) generally has a peak molecular weight of 1,000 to 10,000, preferably 2,000 to 8,000, further preferably 2,000 to 5,000, When the peak molecular weight of the unmodified polyester is less than 1,000, the resistance to high temperature storage becomes poor, and, when the peak molecular weight is more than 10,000, the low-temperature fixing property becomes poor. Unmodified polyester (ii) preferably has a hydroxyl value of 5 or more, further preferably 10 to 120, especially preferably 20 to 80, When the hydroxyl value of the unmodified polyester is less than 5, it is difficult to achieve both excellent resistance to high temperature storage and excellent low-temperature fixing property. Unmodified polyester (ii) preferably has an acid value of 1 to 5, more preferably 2 to 4, A wax having a high acid value is used, and hence a binder having a low acid value is advantageously used for the toner used in a binary developer since the binder leads to charging or high volume resistance.

The binder resin generally has a grass transition temperature (Tg) of 35 to 70° C., preferably 55 to 65° C. When the grass transition temperature of the binder resin is lower than 35° C., the toner is poor in resistance to high temperature storage, and, when the grass transition temperature is higher than 70° C., the low-temperature fixing property is unsatisfactory. The urea-modified polyester is likely to be present on the surface of the toner base particles obtained, and therefore, in the toner according to the embodiment of the present invention, even when the binder resin has a low grass transition temperature, as compared to that of the binder resin in a known polyester toner, the resistance to high temperature storage can be excellent.

As a coloring agent, any known dye or pigment can be used, and there can be used, for example, carbon black, nigrosine dye, iron black, naphthol yellow S, Hansa yellow (10G, 5G, G), cadmium yellow, yellow oxide, yellow ocher, chrome yellow, titanium yellow, polyazo yellow, oil yellow, Hansa yellow (GR, A, RN, R), pigment yellow L, benzidine yellow (G, GR), permanent yellow (NCG), vulcan fast yellow (5G, R), tartrazine lake, quinoline yellow lake, anthracene yellow BGL, isoindolinone yellow, red iron oxide, red lead oxide, lead red, cadmium red, cadmium mercury red, antimony red, permanent red 4R, para red, fire red, para-chloro-ortho-nitroaniline red, lithol fast scarlet G, brilliant fast scarlet, brilliant carmine BS, permanent red (F2R, F4R, FRL, FRLL, F4RH), fast scarlet VD, vulcan fast rubin B, brilliant scarlet G, lithol rubin GX, permanent red F5R, brilliant carmine 6B, pigment scarlet 3B, bordeaux 5B, toluidine maroon, permanent bordeaux F2K, helio bordeaux BL, bordeaux 10B, BON maroon light, BON maroon medium, eosin lake, rhodamine lake B, rhodamine lake Y, alizarin lake, thioindigo red B, thioindigo maroon, oil red, quinacridone red, pyrazolone red, polyazo red, chrome vermilion, benzidine orange, perinone orange, oil orange, cobalt blue, cerulean blue, alkaline blue lake, peacock blue lake, victoria blue lake, nonmetal phthalocyanine blue, phthalocyanine blue, fast sky blue, indanthrene blue (RS, BC), indigo, ultramarine, Prussian blue, anthraquinone blue, fast violet B, methyl violet lake, cobalt violet, manganese violet, dioxane violet, anthraquinone violet, chrome green, zinc green, chromium oxide, viridian, emerald green, pigment green B, naphthol green B, green gold, acid green lake, malachite green lake, phthalocyanine green, anthraquinone green, titanium oxide, zinc white, lithopone, and a mixture thereof. The amount of the coloring agent added is generally 1 to 15% by weight, preferably 3 to 10% by weight, based on the weight of the toner.

The coloring agent can be used in the form of a masterbatch including the coloring agent mixed with a resin. Examples of binder resins used in the preparation of a masterbatch or kneaded with a masterbatch include polymers of styrene or a substituted compound thereof or copolymers of styrene or a substituted compound thereof with a vinyl compound, such as polystyrene, poly-p-chlorostyrene, and polyvinyl toluene, polymethyl methacrylate, polybutyl methacrylate, polyvinyl chloride, polyvinyl acetate, polyethylene, polypropylene, polyester, epoxy resins, epoxy polyol resins, polyurethane, polyamide, polyvinyl butyral, polyacrylic resins, rosin, modified rosin, terpene resins, aliphatic or alicyclic hydrocarbon resins, aromatic petroleum resins, chlorinated paraffin, and paraffin wax, and they can be used individually or in combination.

As a lubricating agent, a low melting-temperature wax having a melting temperature of 50 to 120° C. contained in the dispersion with a binder resin considerably effectively functions as a lubricating agent at the interface between the fixing roller and the toner, making it unnecessary to apply a lubricant, such as oil, to the fixing roller, thus offering an effect on hot offset. As examples of such wax components, there can be mentioned the following waxes. Examples of waxes include vegetable waxes, such as carnauba wax, cotton wax, wood wax, and rice wax; animal waxes, such as beeswax and lanolin; mineral waxes, such as ozokerite and ceresin; and petroleum waxes, such as paraffin, microcrystalline wax, and petrolactum. In addition to these natural waxes, examples include synthetic hydrocarbon waxes, such as Fischer-Tropsch wax and polyethylene wax; and synthetic waxes, such as ester, ketone, and ether. Further, fatty acid amide, such as 12-hydroxystearic acid amide, stearic acid amide, phthalic anhydride imide, or chlorinated hydrocarbon; or a crystalline polymer having a long alkyl group in its side chain, for example, a polyacrylate homopolymer, such as poly-n-stearyl methacrylate or poly-n-lauryl methacrylate, or copolymer (such as a n-stearyl acrylate-ethyl methacrylate copolymer), which is a low molecular-weight crystalline polymer resin, can be used.

The lubricating agent can be either melt-kneaded with a masterbatch and a binder resin or added when dissolved or dispersed in an organic solvent.

As an external additive for improving the toner particles in flowability, development property, and electrostatic property, inorganic fine particles are preferably used. The inorganic fine particles preferably have a primary particle diameter of $5\times10^{-3}$ to 2 micrometers, especially preferably $5\times10^{-3}$ to 0.5 micrometer. The inorganic fine particles preferably have a specific surface area of 20 to 500 $m^2/g$, as measured by a BET method. The amount of the inorganic fine particles used is preferably 0.01 to 5% by weight, especially preferably 0.01 to 2.0% by weight, based on the weight of the toner.

Specific examples of inorganic fine particles include silica, alumina, titanium oxide, barium titanate, magnesium titanate, calcium titanate, strontium titanate, zinc oxide, tin oxide, silica sand, clay, mica, wollastonite, diatomaceous earth, chromium oxide, cerium oxide, red iron oxide, antimony trioxide, magnesium oxide, zirconium oxide, barium sulfate, barium carbonate, calcium carbonate, silicon oxide, and silicon nitride. Among these, as a flowability imparting agent, hydrophobic silica fine particles and hydrophobic titanium oxide fine particles are preferably used in combination. Especially when these two types of fine particles having an average particle diameter of $5\times10^{-2}$ micrometer or less are used and mixed with the toner by agitation, the electrostatic force or van der Waals force of the particles with the toner is remarkably increased, and hence the flowability imparting agent is prevented from leaving the toner during the agitation and mixing in the developing device conducted for obtaining a desired charged level, so that excellent image quality free from generation of spots can be achieved and further the transfer residue toner can be reduced.

The titanium oxide fine particles are excellent in environmental stability and image density stability. However, they tend to lower the charge rising property, and therefore it is considered that, when the amount of the titanium oxide fine particles added is larger than the amount of the silica fine particles added, this side effect is marked. However, when the amount of the hydrophobic silica fine particles and hydrophobic titanium oxide fine particles added is in the range from 0.3 to 1.5% by weight, the charge rising property is not largely lowered, and a desired charge rising property can be obtained, namely, excellent image quality can be constantly achieved even when repeating copying operations.

A method for preparing a toner is explained next. While a preferred production method is explained here, the present invention is not limited thereto.

1) A coloring agent, unmodified polyester, a polyester prepolymer having an isocyanate group, and a lubricating agent are dispersed in an organic solvent to prepare a toner material liquid.

From the viewpoint of facilitating the removal of solvent after forming toner base particles, it is preferred that the organic solvent is volatile and has a boiling point lower than 100° C. Specifically, toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, metyl ethyl ketone, and methyl isobutyl ketone can be used individually or in combination. Especially preferred are aromatic solvents, such as toluene and xylene, and hydrocarbon halides, such as methylene chloride, 1,2-dichloroethane, chloroform, and carbon tetrachloride. The amount of the organic solvent used is generally 0 to 300 parts by weight, preferably 0 to 100 parts by weight, further preferably 25 to 70 parts by weight, relative to 100 parts by weight of the polyester prepolymer.

2) The toner material liquid is emulsified in an aqueous medium in the presence of a surfactant and resin particles.

As an aqueous medium, water can be solely used, or water containing an organic solvent, such as alcohol (for example, methanol, isopropyl alcohol, or ethylene glycol), dimethylformamide, tetrahydrofuran, cellosolve (for example, methyl cellosolve), or lower ketone (for example, acetone or metyl ethyl ketone), can be used.

The amount of the aqueous medium used is generally 50 to 2,000 parts by weight, preferably 100 to 1,000 parts by weight, relative to 100 parts by weight of the toner material liquid. When the amount of the aqueous medium used is less than 50 parts by weight, the resultant toner material liquid has a poor dispersed state, so that toner particles having a predetermined particle diameter cannot be obtained. The amount of more than 20,000 parts by weight is not preferred from an economical point of view.

In addition, for improving the dispersed state in an aqueous medium, an appropriate dispersant, such as a surfactant or resin particles, is added.

Examples of surfactants include anionic surfactants, such as alkylbenzenesulfonic acid salts, α-olefinsulfonic acid salts, and phosphoric esters; cationic surfactants, for example, amine salt type cationic surfactants, such as alkylamine salts, amino alcohol fatty acid derivatives, polyamine fatty acid derivatives, and imidazoline, and quaternary ammonium salt type cationic surfactants, such as alkyltrimethylammonium salts, dialkyldimethylammonium salts, alkyldimethylbenzylammonium salts, pyridinium salts, alkylisoquinolinium salts, and benzethonium chloride; nonionic surfactants, such as fatty acid amide derivatives and polyhydric alcohol derivatives; and amphoteric surfactants, such as alanine, dodecyl(aminoethyl)glycine, di(octylaminoethyl)glycine, and N-alkyl-N,N-dimethylammonium betaine.

A surfactant having a fluoroalkyl group can effectively function even when used in a very small amount. Examples of anionic surfactants having a fluoroalkyl group preferably used include fluoroalkylcarboxylic acids having 2 to 10 carbon atoms and metal salts thereof, disodium perfluorooctanesulfonylglutamate, sodium 3-[(ω-fluoroalkyl($C_6$-$C_{11}$)oxy]-1-alkyl($C_3$-$C_4$)sulfonate, sodium 3-[ω-fluoroalkanoyl($C_6$-$C_8$)-N-ethylamino]-1-propanesulfonate, fluoroalkyl($C_{11}$-$C_{20}$)carboxylic acids and metal salts thereof, perfluoroalkylcarboxylic acids ($C_7$-$C_{13}$) and metal salts thereof, perfluoroalkyl($C_4$-$C_{12}$)sulfonic acids and metal salts thereof, perfluorooctanesulfonic acid diethanolamide, N-propyl-N-(2-hydroxyethyl)perfluorooctanesulfonamide, propyltrimethylammonium salts of perfluoroalkyl($C_6$-$C_{10}$) sulfonamide, perfluoroalkyl($C_6$-$C_{10}$)-N-ethylsulfonylglycine salts, and monoperfluoroalkyl($C_6$-$C_{16}$)ethyl phosphate.

Examples of trade names for the above include Surflon S-111, S-112, and S-113 (Asahi Glass Co., Ltd.), Fluorad FC-93, FC-95, FC-98, and FC-129 (Sumitomo 3M), Unidyne DS-101 and DS-102 (DAIKIN INDUSTRIES, Ltd.), Megafac F-110, F-120, F-113, F-191, F-812, and F-833 (Dainippon Ink & Chemicals Incorporated), Ectop EF-102, 103, 104, 105, 112, 123A, 123B, 306A, 501, 201, and 204 (Tohchem Products Co., Ltd.), and FTERGENT F-100 and F150 (NEOS COMPANY LIMITED).

Examples of cationic surfactants include aliphatic primary, secondary, or secondary amine acids having a fluoroalkyl group, aliphatic quaternary ammonium salts, such as propyltrimethylammonium salts of perfluoroalkyl($C_6$-$C_{10}$) sulfonamide, benzarconium salts, benzethonium chloride, pyridinium salts, and imidazolinium salts, and examples of trade names for the cationic surfactants include Surflon S-121 (Asahi Glass Co., Ltd.), Fluorad FC-135 (Sumitomo 3M), Unidyne DS-202 (DAIKIN INDUSTRIES, Ltd.), Megafac F-150, F-824 (Dainippon Ink & Chemicals Incorporated), Ectop EF-132 (Tohchem Products Co., Ltd.), and FTERGENT F-300 (NEOS COMPANY LIMITED).

As the resin particles, any resin can be used as long as the resin can form an aqueous dispersion, and either a thermoplastic resin or a thermosetting resin can be used. Examples include vinyl resins, polyurethane resins, epoxy resins, polyester resins, polyamide resins, polyimide resins, silicon resins, phenolic resins, melamine resins, urea resins, aniline resins, ionomer resins, and polycarbonate resins. These resins can be used in combination.

Among these, from the viewpoint of obtaining an aqueous dispersion containing finely spherical resin particles, preferred are vinyl resins, polyurethane resins, epoxy resins, polyester resins, and combinations thereof. Examples of vinyl resins include resins, such as polymers obtained by homopolymerizing or copolymerizing vinyl monomers, for example, styrene-(meth)acrylate copolymers, styrene-butadiene copolymers, (meth)acrylic acid-acrylate polymers, styrene-acrylonitrile copolymers, styrene-maleic anhydride copolymers, and styrene-(meth)acrylic acid copolymers. The resin particles can have an average particle diameter of 5 to 200 nanometers, preferably 20 to 300 nanometers.

Furthermore, an inorganic compound dispersant, such as calcium triphosphate, calcium carbonate, titanium oxide, colloidal silica, or hydroxyapatite, can be used.

As a dispersant that can be used in combination with the resin particles and inorganic compound dispersant, a polymer protective colloid can be used to stabilize the dispersed particles. There can be used, for example, a homopolymer or copolymer of an acid, such as acrylic acid, methacrylic acid, α-cyanoacrylic acid, α-cyanomethacrylic acid, itaconic acid, crotonic acid, fumaric acid, maleic acid, or maleic anhydride; (a)an (meth)acrylic monomer containing a hydroxyl group, such as β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylate, diethylene glycol monomethacrylate, glycerol monoacrylate, glycerol monomethacrylate, N-methylolacrylamide, or N-methylolmethacrylamide; vinyl alcohol or vinyl alcohol ether, such as vinyl methyl ether, vinyl ethyl ether, or vinyl propyl ether; an ester of vinyl alcohol and a compound containing a carboxyl group, such as vinyl acetate, vinyl propionate, or vinyl butyrate; acrylamide, methacrylamide, diacetoneacrylamide, or a methylol compound thereof; acid chloride, such as acrylic chloride or methacrylic chloride; a nitrogen-containing compound, such as vinylpyridine, vinylpyrrolidone, vinylimidazole, or ethyleneimine, or a compound having the heterocycle; polyoxy ethylene, such as polyoxy ethylene, polyoxy propylene, polyoxy ethylene alkylamine, polyoxy propylene alkylamine, polyoxy ethylene alkylamide, polyoxy propylene alkylamide, polyoxy ethylene nonyl phenyl ether, polyoxy ethylene lauryl phenyl ether, polyoxy ethylene stearyl phenyl ester, or polyoxy ethylene nonyl phenyl ester; or cellulose, such as methyl cellulose, hydroxyethyl cellulose, or hydroxypropyl cellulose.

With respect to the method for dispersion, there is no particular limitation, and a known apparatus of a low shear-rate type, high shear-rate type, friction type, high-pressure jet type, or ultrasonic type can be used. Among these, for obtaining a dispersion containing dispersed particles having a particle diameter of 2 to 20 micrometers, an apparatus of a high shear-rate type is preferred. When a high shear-rate type dispersion mixer is used, with respect to the number of revolutions, there is no particular limitation. It is generally 1,000 to 30,000 revolutions per minute (rpm), and preferably 5,000 to 20,000 rpm. With respect to the dispersion time, there is no particular limitation. In a batch method, the dispersion time is generally 0.1 to 5 minutes. The temperature for the dispersion is generally 0 to 150° C. (under pressure), preferably 40 to 98° C.

3) Amine (B) is added upon preparing an emulsion and reacted with polyester prepolymer (A) having ah isocyanate group.

This reaction causes any one of crosslinking and extension of molecular chains or both. The reaction time is selected depending on the structure of an isocyanate group in polyester prepolymer (A) and the reactivity of the polyester prepolymer to amine (B). The reaction time is generally 10 minutes to 40 hours, and preferably 2 to 24 hours. The reaction temperature is generally 0 to 150° C., preferably 40 to 98° C. A known catalyst can be used if necessary. Specific examples include dibutyltin laurate and dioctyltin laurate.

4) After completion of the reaction, the organic solvent is removed from the emulsified dispersion (reaction mixture), followed by washing and drying, to obtain toner base particles.

For removing the organic solvent, the whole of the system being stirred in a laminar flow is gradually heated, and vigorously stirred in a certain temperature range, followed by removal of the solvent, thus producing spindle-shaped toner base particles. When a substance soluble in an acid or alkali, for example, calcium phosphate is used as a dispersion stabilizer, the calcium phosphate is removed from the toner base particles by, for example, a method in which the calcium phosphate is dissolved in an acid, such as hydrochloric acid, followed by washing with water. Alternatively, the salt can be removed by an operation for decomposition using an enzyme.

5) If necessary, a charge controlling agent is introduced to the obtained toner base particles, and then inorganic fine particles, such as silica fine particles or titanium oxide fine particles, are added to obtain a toner.

The incorporation of a charge controlling agent and the addition of inorganic fine particles are conducted by a known method using, for example, a mixer.

Thus, a toner having a small particle diameter and sharp particle diameter distribution can be easily obtained. By vigorously stirring the toner in the,step of removing the organic solvent, the shape of the toner can be controlled to be, for example, a spherical shape or a rugby ball-like shape, and further the morphology of the surface of the toner can be controlled to be, for example, a smooth or uneven surface.

It is preferred that the thus obtained toner is a toner having a small particle diameter and narrow particle diameter distribution such that the volume average particle diameter is 3 to 8 micrometers and the ratio of the volume average particle diameter (Dv) to the number average particle diameter (Dn)(Dv/Dn) is in the range from 1.00 to 1.40, The toner having a small particle diameter can adhere to the latent image at a high density. Furthermore, the toner having narrow particle diameter distribution makes the charged toner amount distribution uniform, thus achieving a high-quality image free from background fogging and improving the transfer ratio.

The use of the toner having a small particle diameter poses problems in the blade cleaning property, however, in the image forming apparatus according to the embodiment of the present invention, an appropriate amount of zinc stearate is applied to the surface of the photosensitive drum 11, thus improving the blade cleaning property and preventing the occurrence of toner filming.

Figure 4A:
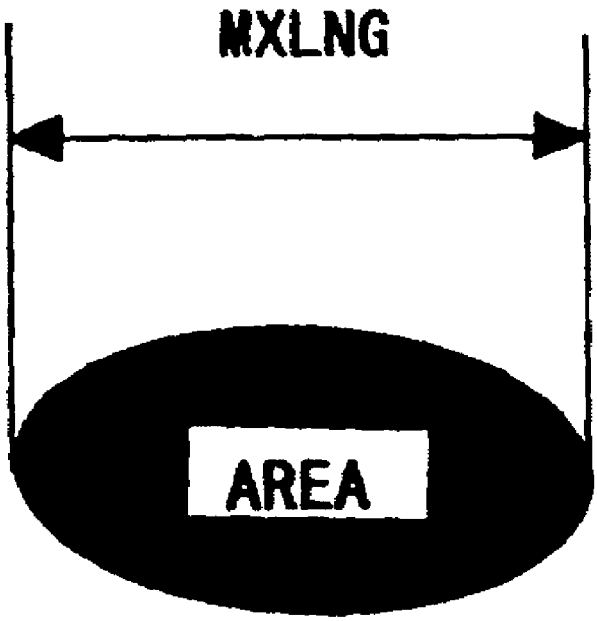
FIGS. 4A and 4B are schematic views of forms of a toner for explaining a shape factor SF-1 and a shape factor SF-2.
Figure 4B:
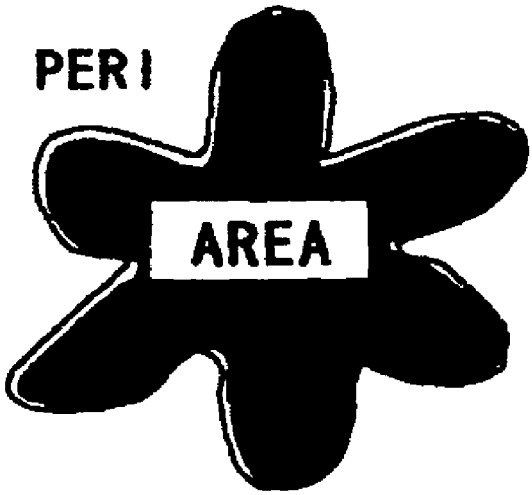

It is preferred that the toner is a spherical toner defined by the following shape factors SF-1 and SF-2. FIGS. 4A and 4B are schematic views of the forms of toner for explaining a shape factor SF-1 and a shape factor SF-2.

The shape factor SF-1 indicates roundness of the shape of toner, which is represented by the Equality (2) below, and which is a value determined by dividing the square of maximum length MXLNG of a figure, which is obtained by projecting the toner to a two-dimensional plane, by area AREA of the figure, and multiplying the obtained value by $100\pi/4$.

$$SF\text{-}1=\{(\mathrm{MXLNG})^2/\mathrm{AREA}\}\times(100\pi/4) \quad (2)$$

When SF-1 is 100, the toner has a spherical shape, and, the larger the SF-1 value, the more indefinite the shape of the toner.

The shape factor SF-2 indicates unevenness of the shape of toner, which is represented by the Equality (3) below, and which is a value determined by dividing the square of perimeter PERI of a figure, which is obtained by projecting the toner to a two-dimensional plane, by area AREA of the figure, and multiplying the obtained value by $100/4\pi$.

$$SF\text{-}2=\{(\mathrm{PERI})^2/\mathrm{AREA}\}\times(100/4\pi) \quad (3)$$

When SF-2 is 100, the toner has no uneven surface, and, the larger the SF-2 value, the more remarkable the unevenness of the surface of the toner.

Specifically, a shape factor is measured by a method in which a photomicrograph of toner is taken by a scanning electron microscope (S-800; Hitachi, Ltd.) and introduced to an image analyzer (LUSEX3; NIRECO Corporation) to make analyses and calculations.

The toner according to the embodiment of the present invention has SF-1 in the range from 100 to 180 and having SF-2 in the range from 100 to 180, When the toner has a substantially spherical shape, the toner and another toner or the toner and the photosensitive drum 11 are substantially in contact with each other at a point, and therefore the adsorption of the toner on another is lowered to increase the toner flowability, or the adhesive force of the toner to the surface of the photosensitive drum 11 is lowered to increase the transfer ratio. On the other hand, the spherical toner easily goes into the gap between the cleaning blade 15*a* and the photosensitive drum 11, and therefore it is preferred that each of the shape factors SF-1 and SF-2 of the toner is 100 or more. When each of SF-1 and SF-2 is too high, the toner is disadvantageously scattered over the image, lowering the image quality. For this reason, it is preferred that each of SF-1 and SF-2 is not higher than 180.

The toner has a substantially spherical shape that can be defined as follows.

Figure 5A:
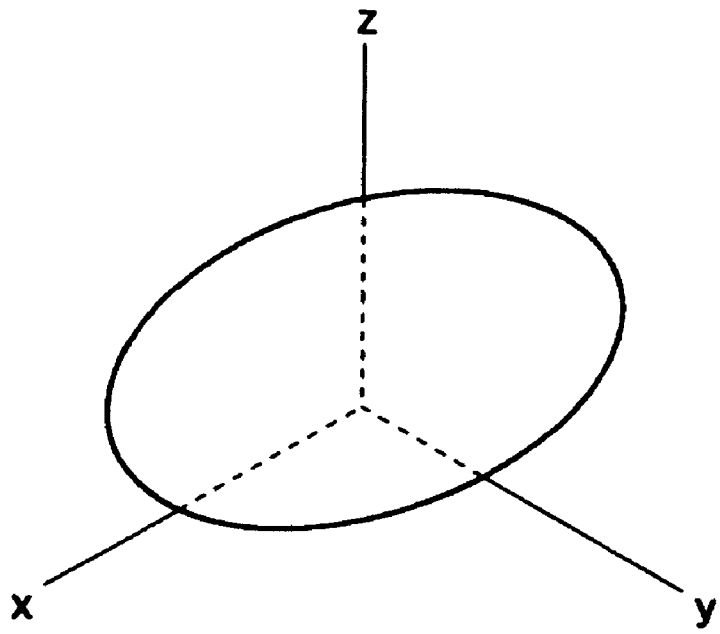
FIGS. 5A to 5C are schematic views of forms of a toner according to the embodiment of the present invention.
Figure 5B:
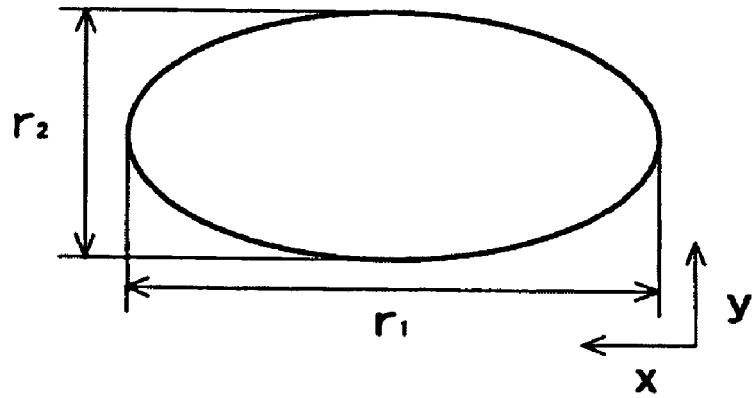
Figure 5C:
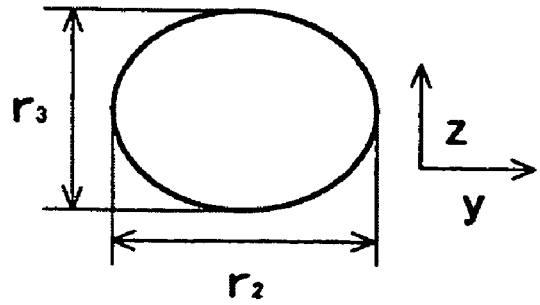

FIGS. 5A to 5C are schematic views of the forms of the toner according to the embodiment of the present invention. In FIGS. 5A to 5C, with respect to the toner according to the embodiment of the present invention, it is preferred that the toner has a substantially spherical shape having a long axis r1, a short axis r2, and a thickness r3 that satisfy a relationship of $r1 \geqq r2 \geqq r3$, wherein the ratio of the short axis to the long axis (r2/r1) (see FIG. 5(*b*)) is in the range from 0.5 to 1.0 and the ratio of the thickness to the short axis (r3/r2) (see FIG. 5(*c*)) is in the range from 0.7 to 1.0, When the ratio of the short axis to the long axis (r2/r1) is less than 0.5, the shape of the toner is not spherical and hence both the dot reproductivity and the transfer efficiency are lowered, thus making it difficult to obtain a high-quality image. When the ratio of the thickness to the short axis (r3/r2) is less than 0.7, the shape of the toner is flattened, making it impossible to obtain a high transfer ratio as obtained when the toner is spherical. Especially when the ratio of the thickness to the short axis (r3/r2) is 1.0, the toner rotates using the long axis as a rotating shaft, thus improving the toner flowability.

Each of r1, r2, r3 is measured by taking pictures of the toner by a scanning electron microscope (SEM) at different viewing angles and observing them.

The toner can have a feature such that it is obtained by adding silica fine particles having an average primary particle diameter of 50 to 300 nanometers and having a bulk density equal to or more than 0.3 g/cm$^3$ to the surface of toner base particles.

The bulk density of silica was measured by the following method.

Using a 100-milliliter measuring cylinder, 100 milliliters of silica fine particles were slowly placed in the measuring cylinder. At this time, no vibration was applied to the particles. A bulk density of the silica fine particles was determined from a difference between the weights of the measuring cylinder measured before and after the silica fine particles were placed.

$$\text{Bulk density (g/cm}^3\text{)}=\text{Silica amount (g/100 ml)}\div 100$$

The silica fine particles having a bulk density equal to or more than 0.3 g/cm$^3$ are likely to uniformly adhere to the surface of the toner without suffering coagulation, and hence the toner itself is prevented from rolling in a region where the toner is in contact with the photoconductor at the tip of the cleaning blade, thus achieving satisfactory cleaning performance.

In addition, the environmental dependency resistance and the storage stability are improved.

When silica particles having an average primary particle diameter of less than 50 nanometers are used, a satisfactory barrier for preventing the toner from passing under the blade cannot be formed in a region where the toner is in contact with the photoconductor at the tip of the cleaning blade, or there cannot be prevented a phenomenon such that the toner itself rolls in the above region to pass under the blade, so that an effect to improve the cleaning performance cannot be obtained.

Silica particles having an average primary particle diameter of larger than 300 nanometers are easily removed from the surface of the toner, thus causing a problem in that the toner solely adheres to the surface of, for example, the latent image carrier, so that toner filming is likely to occur.

Hereinbelow, the present invention is explained with reference to the following Examples.

The lubricant consumption was measured and the image was inspected with respect to problems while changing the lubricant consumption per 1,500 meters of a traveling distance of a photoconductor. A method for changing the lubricant consumption per 1,500 meters of the traveling distance of the photoconductor is such that the pressure of a spring that presses the lubricant was changed. In the following experiments, a remodeled machine of imagio-NeoC385 was used. Examples for the experiments are shown below.

An example 1 is described below. The lubricant consumption was measured and the image was inspected with respect to problems under the standard printing conditions.

Conditions

Toner Degree of circularity: 0.96

Average particle diameter: 6.0 micrometers

Pressure of lubricant shaped article to brush roller:

Springs (1,200 millinewtons)×2

Brush roller: Conductive PET Brush (TSUCHIYA CO., LTD.)

Printing conditions: Three sheets of paper per one job

Image area ratio: 5%

The results of the experiments are explained. The results of the experiments are shown in the table below. The table shows a traveling distance of the photoconductor and the lubricant consumption used in the experiments, the lubricant consumption in each measurement section (i.e., in terms of per 1,500 meters), and image problems caused in each measurement section. The problems of image inspected in the present experiments include the occurrence of unprinted portions, black lines, and a cleaning failure. The image problems were individually examined by halftone printing after the printing for 500 sheets of paper under the respective conditions. Under the conditions employed, printing for 60,000 sheets of paper was conducted in each Example. That is, printing for 60,000 sheets of paper was conducted with a photoconductor traveling distance of about 35,000 meters.

As can seen from the results shown in Table 1, when the lubricant consumption was 0.09 gram with a photoconductor traveling distance of 29,508 to 35,420 meters, filming on the photoconductor occurred and unprinted portions were caused. Furthermore, the occurrence of filming increased the friction coefficient of the photoconductor to cause a cleaning failure. In this case, the friction coefficient of the photoconductor was 0.45, As apparent from the above, it is required that the lubricant consumption be equal to or more than 0.1 gram per 1,500 meters of the traveling distance of the photoconductor.

TABLE 1

| Traveling Distance (m) | Lubricant Consumption (g) | Lubricant Consumption In Each Measurement Section (Per 1,500 m) (g) | Unprinted Portions | Black Lines | Cleaning Failure |
|---|---|---|---|---|---|
| 0 | 0 | | | | |
| | | 0.56 | ○ | ○ | ○ |
| 5394 | 2.2 | | | | |
| | | 0.52 | ○ | ○ | ○ |
| 11856 | 4.3 | | | | |
| | | 0.46 | ○ | ○ | ○ |
| 17746 | 6.1 | | | | |
| | | 0.36 | ○ | ○ | ○ |
| 23630 | 7.5 | | | | |
| | | 0.21 | ○ | ○ | ○ |
| 29508 | 8.4 | | | | |
| | | 0.09 | X | ○ | X |
| 35420 | 8.6 | | | | |

An example 2 is described below. Under conditions such that the lubricant consumption was the upper limit and the printing conditions, the lubricant consumption was measured and the image was inspected with respect to problems.

Toner Degree of circularity: 0.96

Average particle diameter: 6.0 micrometers

Pressure of lubricant shaped article to brush roller:

Springs (1,800 millinewtons)×2

Brush roller: Conductive PET Brush (TSUCHIYA CO., LTD.)

Printing conditions: Three sheets of paper per one job

Image area ratio: 5%

Using two springs each at a lubricant pressure of 1,800 millinewtons, the lubricant consumption was increased. As can be seen from the results shown in Table 2, no problems occurred.

TABLE 2

| Traveling Distance (m) | Lubricant Consumption (g) | Lubricant Consumption In Each Measurement Section (Per 1,500 m) (g) | Unprinted Portions | Black Lines | Cleaning Failure |
|---|---|---|---|---|---|
| 0 | 0 | | | | |
| | | 1.2 | ○ | ○ | ○ |
| 5889 | 4.7 | | | | |
| | | 1.2 | ○ | ○ | ○ |
| 11757 | 9.4 | | | | |
| | | 1.2 | ○ | ○ | ○ |
| 17585 | 14 | | | | |
| | | 1.0 | ○ | ○ | ○ |
| 23419 | 18 | | | | |
| | | 0.8 | ○ | ○ | ○ |
| 29231 | 21 | | | | |
| | | 0.3 | ○ | ○ | ○ |
| 35093 | 22 | | | | |

An example 3 is described below. The lubricant pressure was increased so that the lubricant consumption was increased, as compared to that in Example 2, and the lubricant consumption was measured and the image was inspected with respect to problems.

Toner Degree of circularity: 0.96

Average particle diameter: 6.0 micrometers

Pressure of lubricant shaped article to brush roller:

Springs (2,000 millinewtons)×2

Brush roller: Conductive PET Brush (TSUCHIYA CO., LTD.)

Printing conditions: Three sheets of paper per one job

Image area ratio: 5%

As can be seen from the results shown in Table 3, when the lubricant consumption was 1.4 gram per 1,500 meters of the traveling distance of the photoconductor, black lines were caused. From the fact that replacing the charging roller in the photosensitive unit used in this Example by a new roller provided images free from black lines, it is considered that contaminants on the charging roller caused black lines.

TABLE 3

| Traveling Distance (m) | Lubricant Consumption (g) | Lubricant Consumption In Each Measurement Section (Per 1,500 m) (g) | Unprinted Portions | Black Lines | Cleaning Failure |
|---|---|---|---|---|---|
| 0 | 0 | | | | |
| | | 1.6 | ○ | ○ | ○ |
| 5889 | 6.4 | | | | |
| | | 1.4 | ○ | X | ○ |
| 11757 | 12.0 | | | | |

When the lubricant consumption amount is in the range defined in the present invention, excellent images free from defectiveness caused by a cleaning failure or the filming on the surface of the photoconductor can be constantly obtained.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

an image carrier that carries a latent image;

a charging unit that electrostatically charges a surface of the image carrier;

an exposure unit that subjects electrostatically charged surface of the image carrier to exposure according to image data to write a latent image on the surface;

a developing unit that supplies a toner to the latent image formed on the surface of the image carrier to visualize the latent image into a visible image;

a transfer unit that transfers the visible image from the surface of the image carrier to another surface;

a cleaning unit, being in contact with the surface of the image carrier, that removes the toner remaining on the surface of the image carrier by a rotatable brush roller and a cleaning blade placed downstream of the brush roller, wherein the cleaning unit includes an elastic blade, and the elastic blade is made to abut against the image carrier at a linear pressure of 0.1 N/cm to 0.5 N/cm; and a lubricant applying unit that includes a lubricant and a brush roller, wherein the brush roller rotates and scrapes the lubricant to apply the lubricant to the surface of the image carrier, wherein the image forming apparatus has a lubricant consumption of 0.1 gram to 1.2 grams per 1,500 meters of a traveling distance of the image carrier;

wherein the image carrier and the charging unit are disposed having a gap therebetween.

2. The image forming apparatus according to claim 1, wherein the lubricant applying unit presses the lubricant against the brush roller at a pressure equal to or more than 200 millinewtons.

3. The image forming apparatus according to claim 1, wherein the charging unit includes a cleaner that removes contaminants.

4. A toner for use in the image forming apparatus according to claim 1, the toner having an average degree of circularity of 0.93 to 1.00.

5. The toner according to claim 4, wherein the toner has a shape factor SF-1 in the range from 100 to 180, and a shape factor SF-2 in the range from 100 to 180.

6. The toner according to claim 4, wherein the toner has a substantially spherical shape.

7. The toner according to claim 4, wherein the toner has a shape having a long axis r1, a short axis r2, and a thickness r3 that satisfy a relationship of $r1 \geqq r2 \geqq r3$, wherein the ratio of the short axis r2 to the long axis r1 (r2/r1) falls in the range from 0.5 to 1.0 and the ratio of the thickness r3 to the short axis r2 (r3/r2) falls in the range from 0.7 to 1.0.

8. The toner according to claim 4, wherein the toner is obtained by adding silica fine particles having an average primary particle diameter of 50 to 300 nanometers and having a bulk density equal to or more than 0.3 g/cm$^3$ to the surface of toner base particles.

9. The toner according to claim 4, wherein the toner is used in a development step for electrophotographic process, wherein the toner is obtained by subjecting a toner material liquid to any one of crosslinking and extension reaction or both in an aqueous medium, wherein the toner material liquid includes an organic solvent having dispersed therein at least a polyester prepolymer having a functional group containing a nitrogen atom, polyester, a coloring agent, and a lubricating agent.

10. The image forming apparatus according to claim 1, wherein the toner used in the developing unit is obtained by subjecting a toner material liquid to any one of crosslinking and extension reaction or both in an aqueous medium, wherein the toner material liquid includes an organic solvent having dispersed therein at least a polyester prepolymer having a functional group containing a nitrogen atom, polyester, a coloring agent, and a lubricating agent.

* * * * *